US007980046B2

(12) United States Patent
Yousefpour et al.

(10) Patent No.: US 7,980,046 B2
(45) Date of Patent: Jul. 19, 2011

(54) APPARATUS FOR CLEANING, FILLING, AND CAPPING A CONTAINER

(75) Inventors: Ali Reza Yousefpour, Waxhaw, NC (US); Robert Wesley Brown, Charlotte, NC (US); Daniel Pompei Cedrone, Huntersville, NC (US)

(73) Assignee: H2Local, Inc., Huntersville, NC (US)

( * ) Notice: Subject to any disclaimer, the term of this patent is extended or adjusted under 35 U.S.C. 154(b) by 184 days.

(21) Appl. No.: 12/390,098

(22) Filed: Feb. 20, 2009

(65) Prior Publication Data

US 2009/0205746 A1 Aug. 20, 2009

Related U.S. Application Data

(60) Provisional application No. 61/066,439, filed on Feb. 20, 2008.

(51) Int. Cl.
*B65B 7/28* (2006.01)

(52) U.S. Cl. ..... 53/471; 53/167; 53/284.5; 53/284.6; 53/79; 53/485

(58) Field of Classification Search ..... 53/167, 53/48.1, 48.5, 48.7, 425, 473, 484–485, 79, 53/284.5, 284.6, 467, 471
See application file for complete search history.

(56) References Cited

U.S. PATENT DOCUMENTS

| | | | | |
|---|---|---|---|---|
| 2,631,872 | A | 3/1953 | Wurmser | |
| 3,393,491 | A | 7/1968 | Burton et al. | |
| 3,901,180 | A * | 8/1975 | Allen et al. | 118/679 |
| 4,573,505 | A | 3/1986 | Lee et al. | |
| 5,425,402 | A | 6/1995 | Pringle | |
| 5,441,063 | A | 8/1995 | Fernandez et al. | |
| 6,341,630 | B2 | 1/2002 | Reinecke | |
| 6,343,628 | B2 | 2/2002 | Reinecke | |
| 6,351,924 | B1 * | 3/2002 | Gustafsson et al. | 53/425 |
| 6,684,602 | B2 | 2/2004 | Reinecke | |
| 6,920,905 | B2 * | 7/2005 | Maria | 141/168 |
| 7,055,677 | B2 * | 6/2006 | Hartness et al. | 198/803.7 |
| 7,162,849 | B2 | 1/2007 | Bernhard | |
| 7,185,753 | B2 * | 3/2007 | Hartness et al. | 198/474.1 |
| 7,216,758 | B2 * | 5/2007 | Hartness et al. | 198/803.7 |
| 7,261,199 | B2 * | 8/2007 | Hartness et al. | 198/470.1 |
| 7,299,607 | B2 | 11/2007 | Clusserath et al. | |
| 7,392,632 | B2 | 7/2008 | Wiedemann et al. | |

OTHER PUBLICATIONS

International Search Report and Written Opinion mailed May 3, 2010.

* cited by examiner

*Primary Examiner* — Christopher Harmon
(74) *Attorney, Agent, or Firm* — Summa, Additon & Ashe, P.A.

(57) ABSTRACT

An apparatus for filling a container includes an enclosure (11) having an opening for receiving a container (14). The apparatus may include a shuttle assembly (15), a wash station (20), a fill station (21), and a seal station (16) contained within the enclosure (11). The shuttle assembly (15) may include a frame structure (23) and a shuttle (22). The shuttle (22) may advance along a path of travel and facilitate the washing, filling, and sealing of the container (14). The apparatus may be employed in a method for consecutively washing, filling, and sealing at least one container in an enclosed housing. The method includes the steps of providing at least one container, washing the container, filling the container, and sealing the container. The method may be conducted along a path of travel.

26 Claims, 6 Drawing Sheets

APPARATUS FOR CLEANING, FILLING, AND CAPPING A CONTAINER

CROSS-REFERENCE TO PRIORITY APPLICATION

This application hereby claims the benefit of the Provisional Patent Application Ser. No. 61/066,439 (filed Feb. 20, 2008) which is hereby incorporated by reference in its entirety.

FIELD OF THE INVENTION

The invention relates to an apparatus and method for washing, filling, and sealing one or more containers.

BACKGROUND

Consumable liquids (e.g., water, soda, and juice) are commonly packaged in individual containers such as glass or plastic bottles. The bottling of such containers typically takes place on a large industrial scale. For example, a large conveyor advances containers through various stages of the bottling process (e.g., filling and capping the bottles).

Although suitable for large-scale production of filled containers, such bottling machinery is not suitable for local, small-scale production of filled containers at locations such as restaurants, cafeterias, businesses, and resorts. For example, such bottling machinery requires a large space. Moreover, acquiring such bottling machinery requires significant initial capital outlays and operating the machinery is expensive.

Accordingly, a need exists for an apparatus for filling a container that takes up minimal space and is suitable for small-scale production of filled containers. Such an apparatus would also have the added advantage of being readily transportable to various locations. A need also exists for an apparatus that is relatively inexpensive. Furthermore, it is desirable to have an apparatus capable of cleaning used containers (e.g., sanitizing) such that the containers can be filled, sealed, and reused.

SUMMARY OF THE INVENTION

In one embodiment, the present invention embraces a novel apparatus for filling a container with, for example, a liquid. The apparatus includes an enclosure, a shuttle assembly housed by the enclosure, and a frame structure defined by the shuttle assembly. The enclosure has one or more (i.e., at least one) openings for receiving a container or containers. The shuttle assembly is configured to receive the container. In operation, the shuttle assembly advances along a path of travel and facilitates the washing, filling, and sealing of the container.

In another embodiment, the present invention provides a novel apparatus for washing, filling, and sealing a container. The apparatus includes an enclosure and a shuttle assembly having a rotatable shuttle secured within the enclosure. A wash station for cleaning the container, a fill station for dispensing liquid into the container, and a seal station for capping the container are also housed by the enclosure (i.e., within the enclosure). Accordingly, each of the work stations are all housed within a single unit or enclosure. The shuttle assembly moves between the wash, fill, and seal stations along a path of travel and facilitates the washing, filling, and sealing of the container.

In another aspect, the present invention embraces a method for consecutively washing, filling, and sealing the containers within an enclosed housing. The method includes the steps of (1) providing at least one container, (2) washing the container, (3) filling the container, and (4) sealing the container. In operation, the method is conducted along a path of travel within the enclosure.

BRIEF DESCRIPTION OF THE DRAWINGS

The foregoing and other objects and advantages of the invention and the manner in which the same are accomplished will become clearer based on the following detailed description taken in conjunction with the accompanying drawings in which.

DETAILED DESCRIPTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
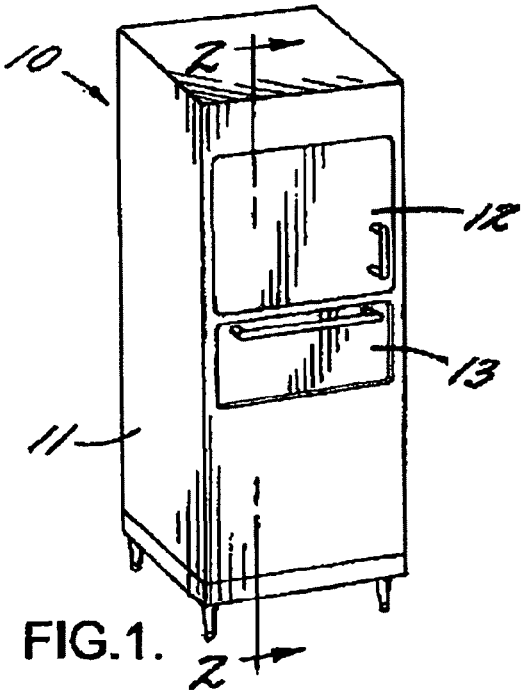
FIG. 1 is a perspective view of an apparatus for filling a container according to one aspect of the present invention.

In one aspect, the present invention embraces an apparatus for filling a container. FIG. 1 depicts an exemplary apparatus 10 for filling a container 14. The container 14 may be any suitable container (e.g., a glass bottle) capable of holding a liquid. The apparatus 10 includes an enclosure 11, a shuttle assembly 15, a shuttle 22, and a drive assembly 28. The enclosure 11 has at least one opening for receiving at least one container 14. For example, FIG. 1 depicts a shuttle assembly door 13, which may receive one or more containers 14. In one embodiment, the enclosure 11 may also include an opening for providing ready access to a seal station 16 housed within the enclosure 11. By way of example, the enclosure 11 may have a seal station door 12.

Figure 2:
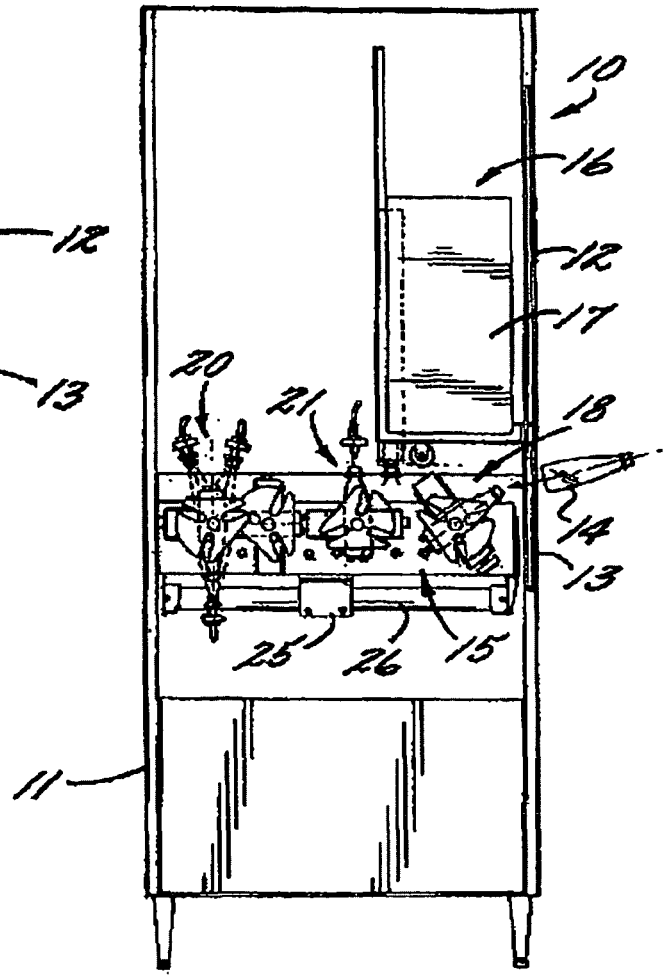
FIG. 2 is a cross-sectional side view of an apparatus for filling a container taken along line 2-2 of FIG. 1 according to one aspect of the present invention.
Figure 3:
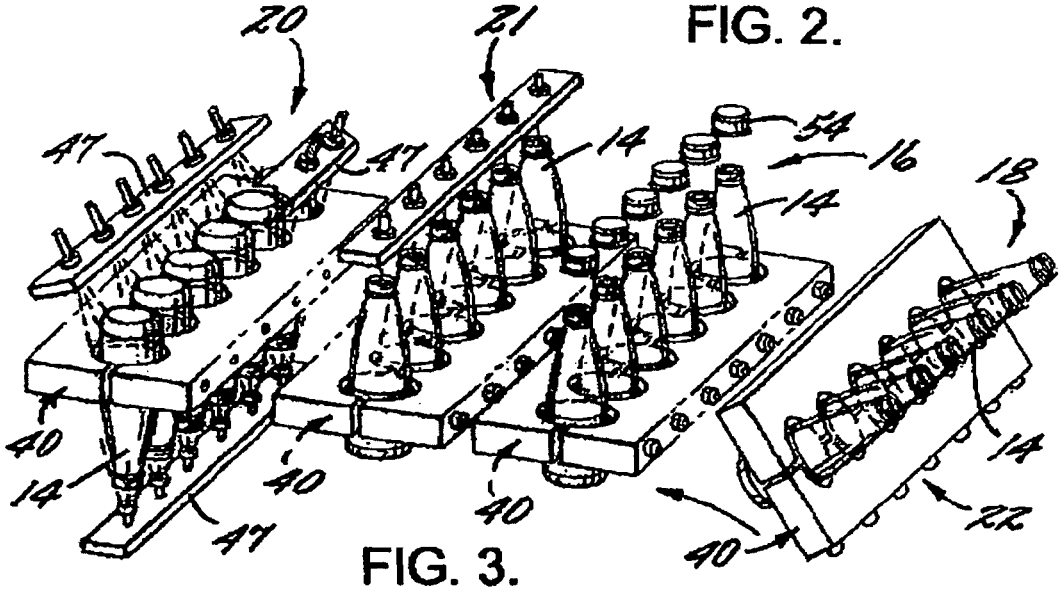
FIG. 3 is a perspective view of a shuttle in various positions according to one aspect of the present invention.
Figure 4:
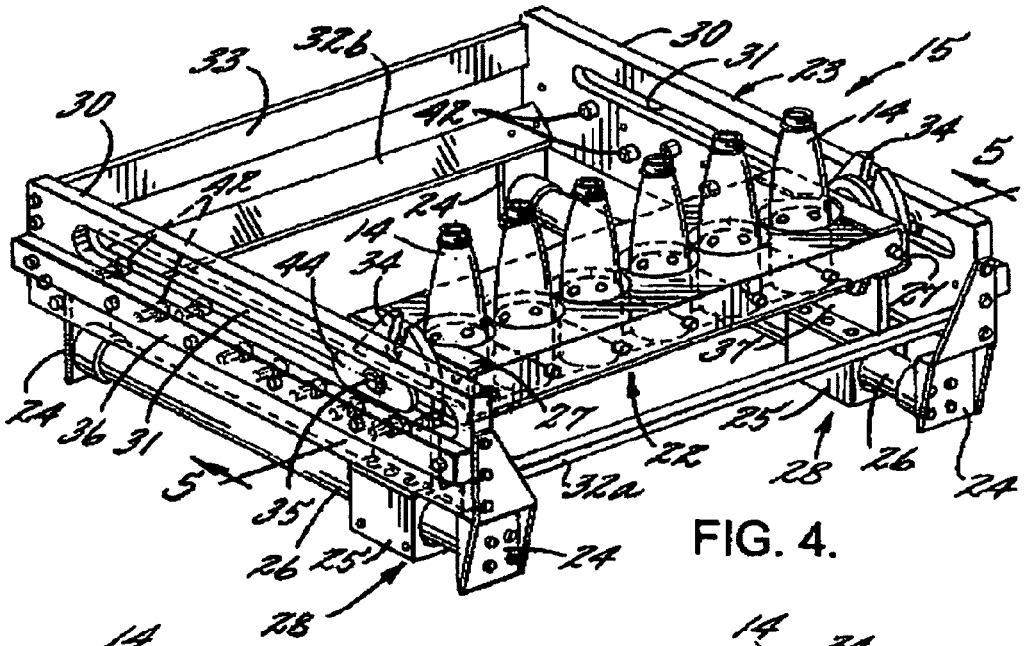
FIG. 4 is a perspective view of a shuttle assembly according to one aspect of the present invention.
Figure 5:
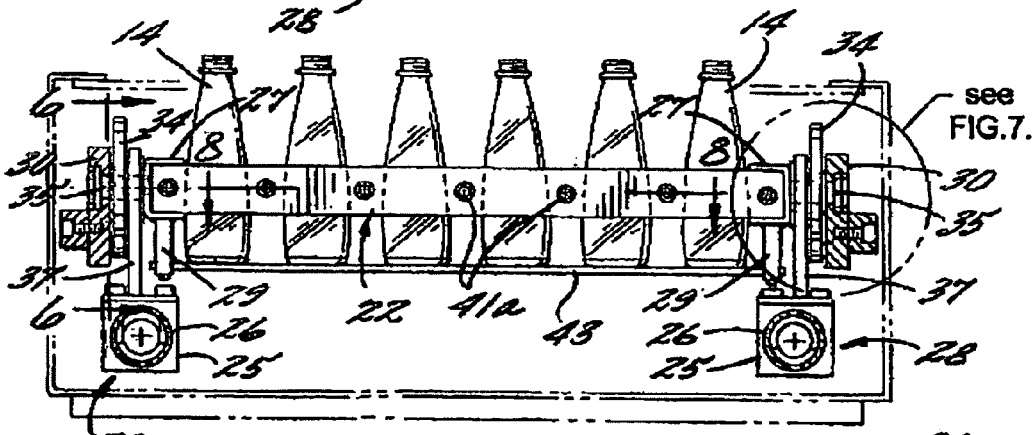
FIG. 5 is a longitudinal sectional view of a shuttle assembly taken along line 5-5 of FIG. 4 according to one aspect of the present invention.
Figure 6:
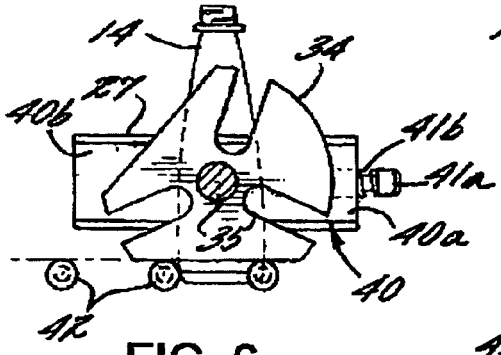
FIG. 6 is a transverse sectional view of the shuttle assembly taken along line 6-6 of FIG. 5 according to one aspect of the present invention.
Figure 7:
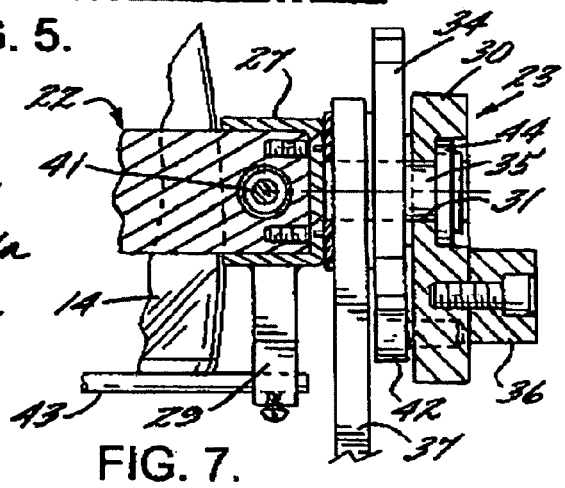
FIG. 7 is an enlarged partial longitudinal view of the shuttle assembly taken from FIG. 5 according to one aspect of the present invention.

FIG. 2 depicts a cross-sectional view of the apparatus 10. The shuttle assembly 15 is configured to receive a container 14 and is housed by the enclosure 11. In operation, a portion of the shuttle assembly 15 advances along a travel path and facilitates the washing, filling, and sealing of the container 14. For example, a portion of the shuttle assembly 15 (as discussed below) may reciprocate between a load/unload station 18, a wash station 20, a fill station 21, and a seal station 16.

FIGS. 4-8 depict the shuttle assembly 15 in more detail. The shuttle assembly 15 may include a shuttle 22 for carrying the container 14 along the travel path (i.e., the path the shuttle travels to facilitate the loading, washing, filling, and sealing of the container 14). Those of ordinary skill in the art will appreciate that the shuttle 22 may be suitable for carrying more than one container (e.g., 6 or 10 containers). Although the travel path is illustrated as extending horizontally with respect to the surface on which the enclosure 11 rests, it will also be understood that the travel path may extend vertically or any number of multiple directions suitable for facilitating the loading, washing, filling, and sealing (as well as unloading) of the container 14.

Figure 8:
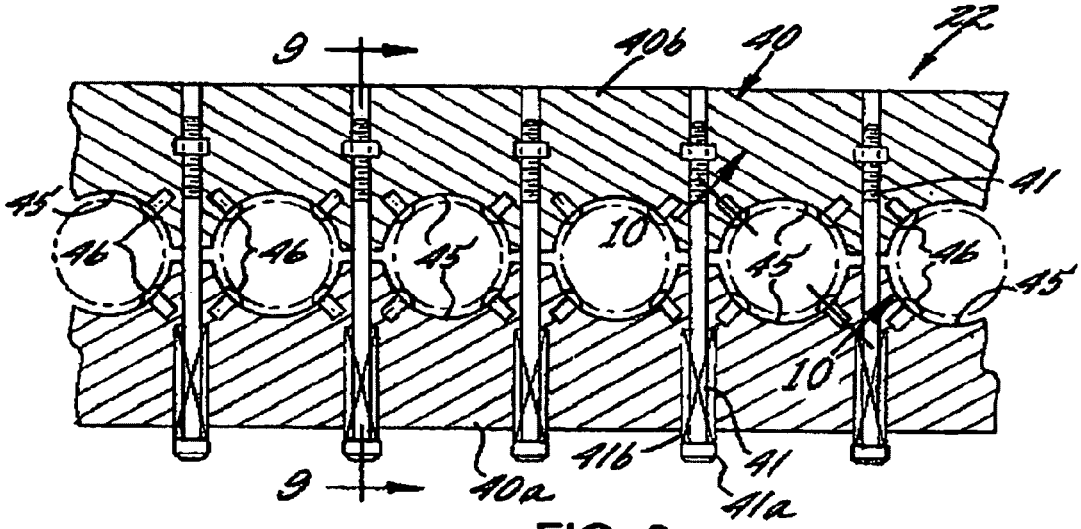
FIG. 8 is a partial top plan view of the shuttle and racks taken along line 8-8 of FIG. 5 according to one aspect of the present invention.

As illustrated in FIG. 8, the shuttle 22 defines at least one opening 45 for receiving and securing the container 14. The opening 45 may have a variable diameter for receiving containers of various shapes and sizes. For example, moveable projections 46 positioned about the periphery of the opening 45 may be used to secure the container 14. By way of further example, moveable projections 46 (i.e., gripper projections) may be adjustable clamping members (e.g., clamping buttons) employed to secure the container 14. It will be understood that the projections or buttons may be moved or actuated (e.g., reciprocated) by any number of drive means to include air, liquid, or mechanical means.

Figure 9:
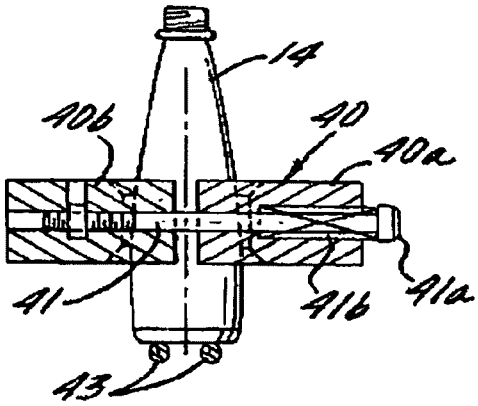
FIG. 9 is a cross-sectional side view of the rack in a second position taken along line 9-9 of FIG. 8 according to one aspect of the present invention.
Figure 9A:
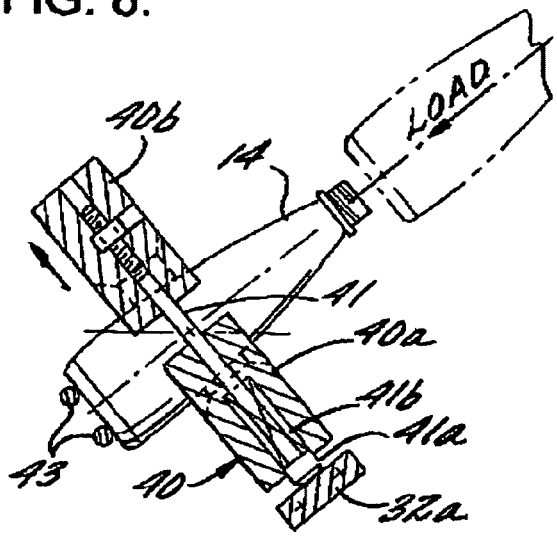
FIG. 9A is a cross-sectional side view of the rack in a first position taken along line 9-9 of FIG. 8 according to one aspect of the present invention.
Figure 10:
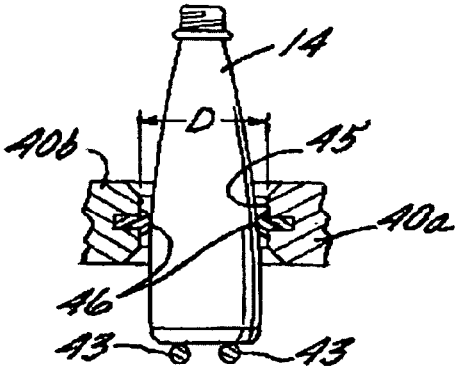
FIG. 10 is a partial cross-sectional oblique view of the rack taken along line 10-10 of FIG. 8 according to one aspect of the present invention.
Figure 10A:
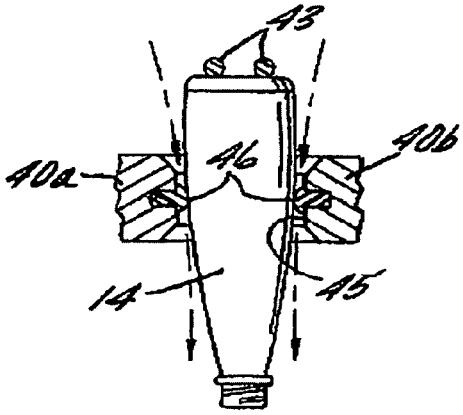
FIG. 10A is a partial cross-sectional oblique view of a rack in a third position taken along line 10-10 of FIG. 8 according to one aspect of the present invention.
Figure 11:
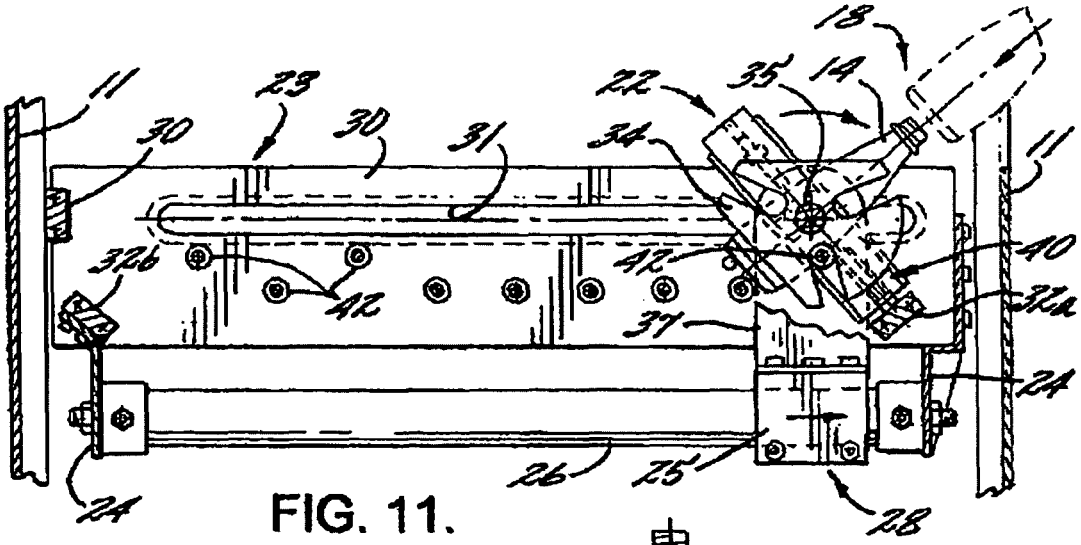
FIGS. 11-11E depict various steps of a method for washing, filling, and sealing at least one container according to another aspect of the present invention.
Figure 11A:
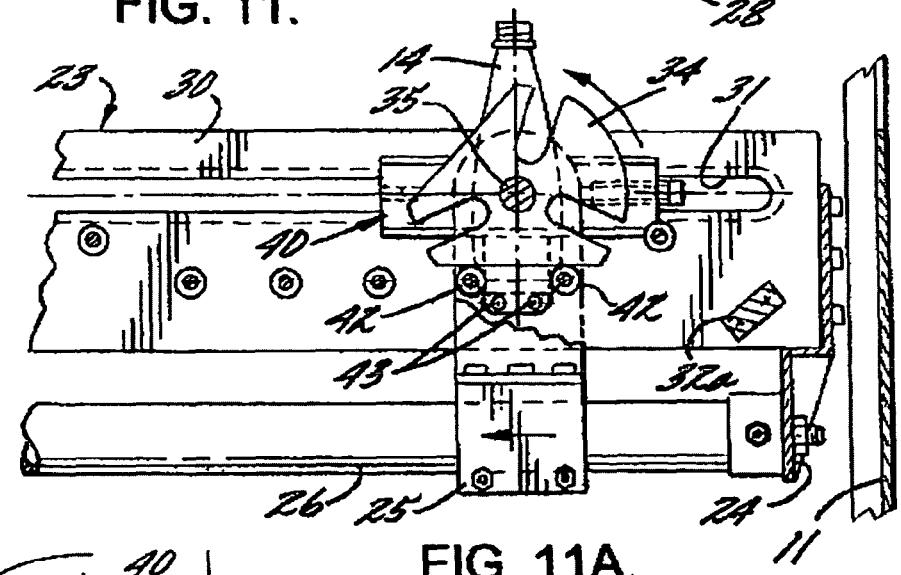
Figure 11B:
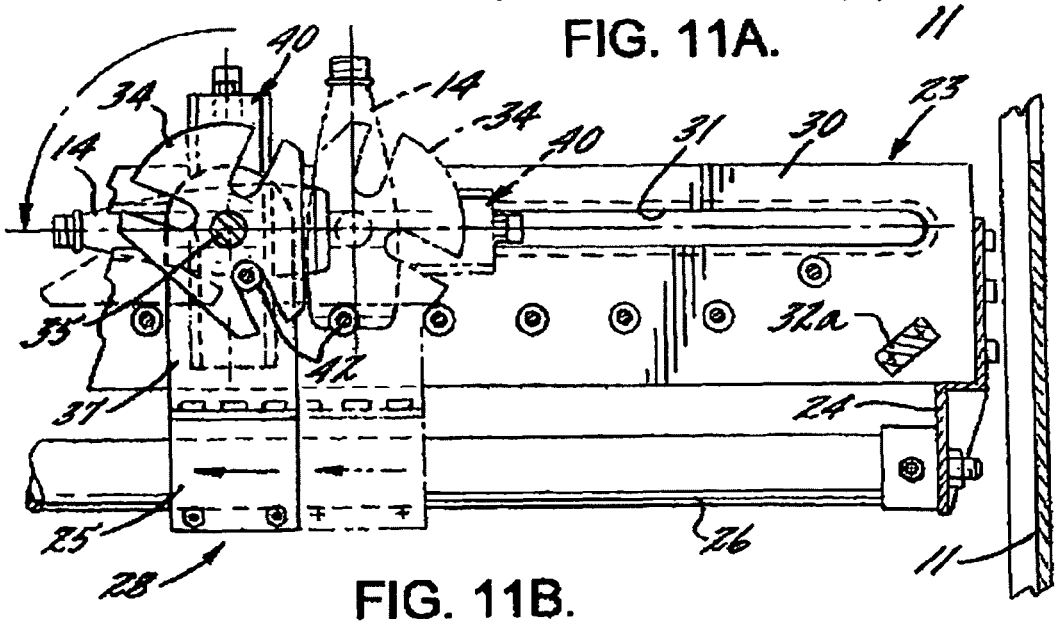
Figure 11C:
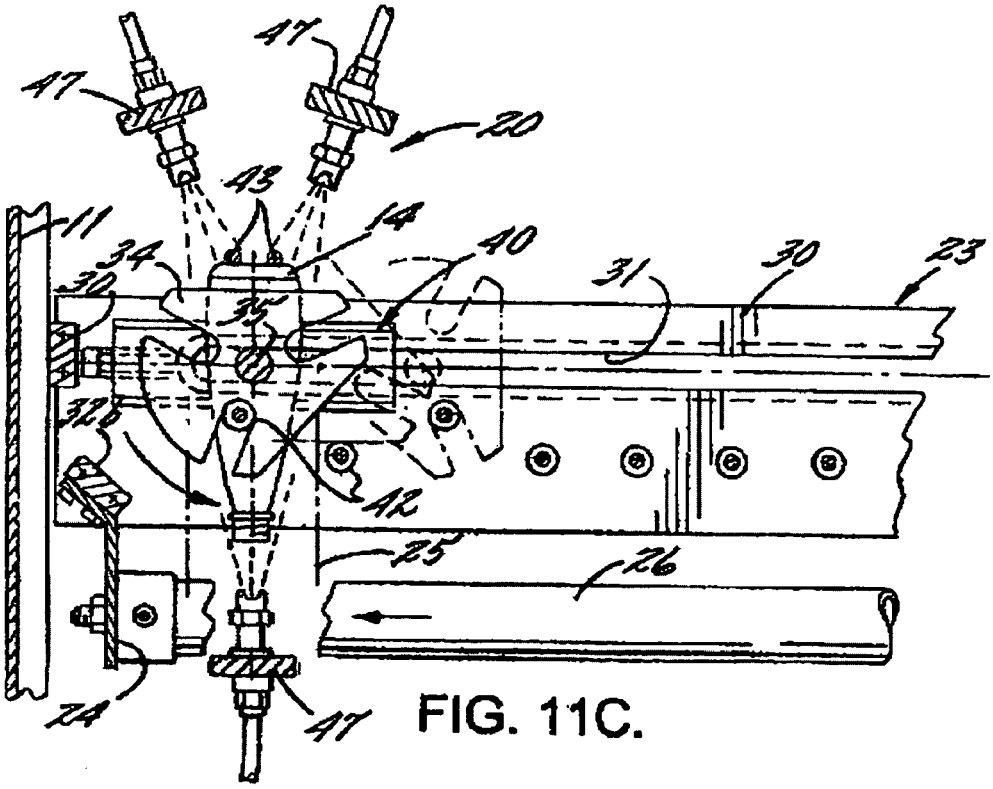
Figure 11D:
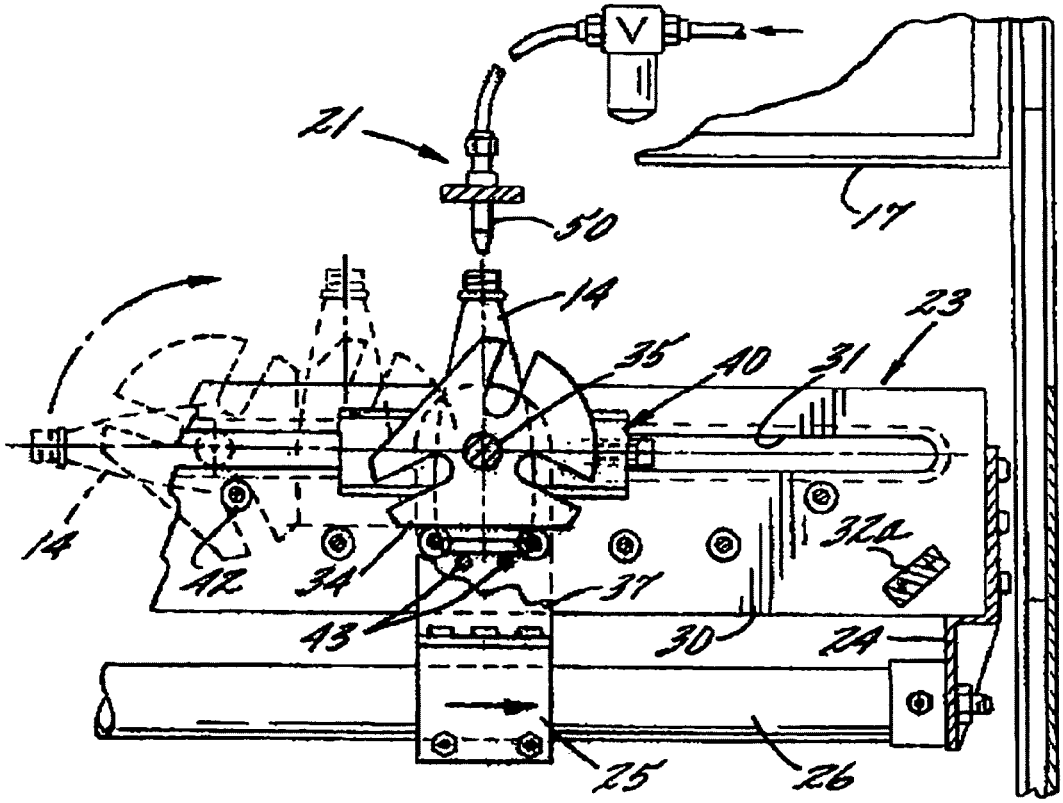
Figure 11E:
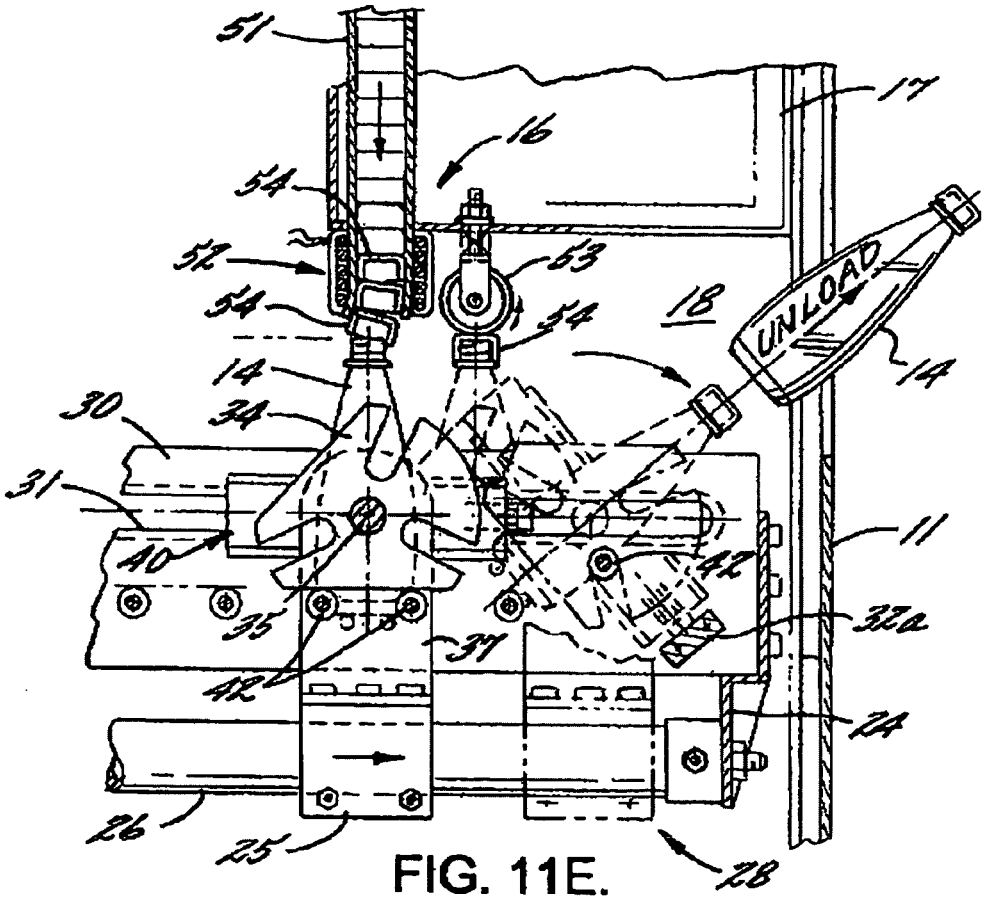

As depicted in FIG. 8, the shuttle 22 may include at least one rack 40 for receiving and securing the container 14. Accordingly and as depicted in FIGS. 8 and 10A, the rack 40 may be defined as having two rack members 40*a* and 40*b* and at least one opening 45 which may have a variable diameter. As illustrated, the rack members 40*a* and 40*b* may be movably secured to one another with connectors 41. In one embodiment, the connectors 41 are spring-loaded bolt connectors. For example, and as illustrated in FIGS. 8 and 9 the rack member 40*b* is shown in a clamped or secured position (i.e., a second position). At this time a connector spring 41*b* is extended to draw the rack member 40*b* to a closed (i.e., clamped or secured) position around the container 14. FIGS. 9A and 11 illustrate the rack 40 into an unclamped position (i.e., open or receiving or first position). At this time the rack member 40*b* is urged open as the connector spring 41*b* is compressed as a result of a bolt head 41*a* making contact with a front cross support 32*a* of the shuttle assembly 15. Thus, when the rack 40 is in a first position (i.e., forward or receiving position), the containers 14 may be easily loaded (FIG. 9A) or unloaded (FIG. 11E).

One or more container support members 43 (e.g., two opposing support members) for supporting the containers (e.g., support rods) may be connected to the shuttle 22 with one or more support member brackets 29 and corresponding shuttle brackets 27. In one embodiment, the invention provides two opposing support member brackets 29. Each support member 43 may extend between the two support member brackets 29.

FIGS. 3, 9, 9A, and 10A depict the rack 40 in various positions. FIG. 9A depicts the rack 40 in a first position configured to receive an empty container 14. FIGS. 9 and 10 depict the rack 40 in a second position configured to secure or grip the container 14 for movement along the travel path. As discussed, one of the rack members 40*a*, 40*b* are moveable between the first and second positions for receiving and securing the container 14. FIG. 10A depicts the rack 40 in a third position configured to grip and rotate the container 14 for cleaning at the wash station 20 while allowing for the cleaning fluid to circulate through the openings 45 about the container 14.

The shuttle assembly 15 may also include a drive assembly 28 for driving the shuttle 22 along the travel path. The shuttle assembly 15 defines a frame structure 23 upon which the drive assembly 28 may be mounted. The frame structure 23 includes one or more side rails 30 (e.g., plates or rails). Opposing cross supports 32*a* and 32*b* connect the side rails 30 one to the other. Likewise, a cross bumper 33 may extend between and connect the rear portions of the side rails 30, thereby providing additional cross support. A tongue 36 for providing additional support to the shuttle assembly 15 may be attached to each side rail 30.

The side rails 30 define a slot 31 that directs the shuttle 22 along the travel path. A shuttle bearing 44 connects the shuttle bracket 27, and therefore the shuttle 22, to the frame structure 23. The shuttle bearing 44 connects to the frame structure 23 by extending (i.e., fitting) into the slot 31.

At least one gear 34 (e.g., a Geneva gear) is connected to the shuttle 22 by a pivot shaft 35, which runs between the shuttle bearing 44 and the shuttle bracket 27. The gear 34 is positioned substantially adjacent to the shuttle 22 such that the gear 34 is between the frame structure 23 and the shuttle 22. Advantageously, the shuttle 22 may be rotatable about a pivot point (e.g., the center of the pivot shaft 35). The pivotal aspect of the shuttle 22 permits the apparatus 10 to adjust the position of the container 14 (e.g., for loading and washing). The gear 34 controls the rotational position of the shuttle 22 (and container 14) as it moves along the travel path in the enclosure 11. One or more cams 42 for directing the rotation of the gear 34 and shuttle 22 may extend along the interior of the frame structure 23 and along the travel path. In particular, openings or shaped portions of the gear 34 engage the cams 42 during movement of the shuttle 22 along the travel path so that the gear 34 rotates the shuttle 22 about the pivot point thereby facilitating the washing, filling, and sealing of the container 14.

Mounting brackets 24 for supporting the drive assembly 28 are secured to the frame structure 23 and to at least a portion of the enclosure 11. In one embodiment, the invention provides a mounting bracket 24 at each corner of the frame structure 23. The drive assembly 28 includes at least one drive assist 26 that may, in one embodiment, extend between two mounting brackets 24. It will be understood that the drive assist 26 may be any number of shapes or sizes that cooperate with (e.g., correspondingly engage) a drive sleeve 25. Stated differently, the drive assist 26 cooperates with the drive sleeve 25 to advance the shuttle 22 along the travel path. The drive sleeve 25 is connected to the mounting brackets 24 and to the shuttle 22 (e.g., with a drive bracket 37). The drive sleeve 25 carries the shuttle 22 along the travel path. In other words, the drive sleeve 25 is moveably connected to the drive assist 26 (i.e., the drive assist 26 extends into the drive sleeve 25) so that the drive sleeve 25 may travel along the length of the drive assist 26. In one embodiment the drive assist 26 is substantially parallel to the travel path of the shuttle 22. In order to effect the movement of the shuttle 22, various types of power, such as pneumatic, hydraulic, and magnetic power, may be used to power the drive assembly 28.

The apparatus 10 further includes a number of stations for cleaning, filling, and capping the container 14. As noted above, the enclosure 11 may house a load/unload station 18, a wash station 20, a fill station 21, and a seal station 16. The load/unload station 18 operates to permit the loading and unloading of the containers. The wash station 20 operates to clean the container 14 prior to filling and capping the container 14. The wash station 20 may include at least one dispensing device 47 (e.g., a sprayer) for dispensing a liquid cleaning solution (e.g., water and/or a sanitizer) against portions of the container 14 (i.e., inside and outside). In one embodiment, FIG. 11C depicts the wash station 20 having three dispensing devices 47. During the wash operation, the gear 34 engages the cams 42 as the shuttle 22 approaches the wash station 20 and pivots or rotates the shuttle 22 to drain the contents of the container 14. Upon completion of the wash operation, the shuttle 22 moves away from the wash station 20 and the gear 34 rotates the shuttle 22 and container 14 to the previous position (i.e., vertical in this embodiment). A water supply provides water to the wash station 20 and dispensing device 47. Advantageously, the washing and sanitizing of existing bottles promotes environmental efficiency and reduces the costs of producing filled containers.

The fill station 21 operates to dispense a liquid (e.g., water or soda) into the container 14. As depicted in FIG. 11D, the fill station 21 includes at least one filling device 50 (e.g., a sprayer or nozzle) for dispensing liquid into the container 14. It will be understood that the filling device 50 may be fixed to the enclosure 11 or secured to a swingarm capable of moving the filling device 50 among various positions. A water supply may provide water to the fill station 21 and filling device 50. A filter (e.g., a sub-micron paper filter or a charcoal filter) may be attached to the water supply to remove impurities from the water. Moreover, an ultraviolet radiation source within the enclosure 11 may serve to kill any pathogens in the water. The fill station 21 may also include a device for inserting additives (e.g., vitamins, minerals, or flavourings) into the water or other liquid.

The liquid may be heated (e.g., above room temperature) before being dispensed into the container 14. Once the liquid cools, a vacuum is created within the container, thereby promoting the use of a tamper-detection or tamper-proof seal such that tampering is readily evident to potential consumers.

Figure 12:
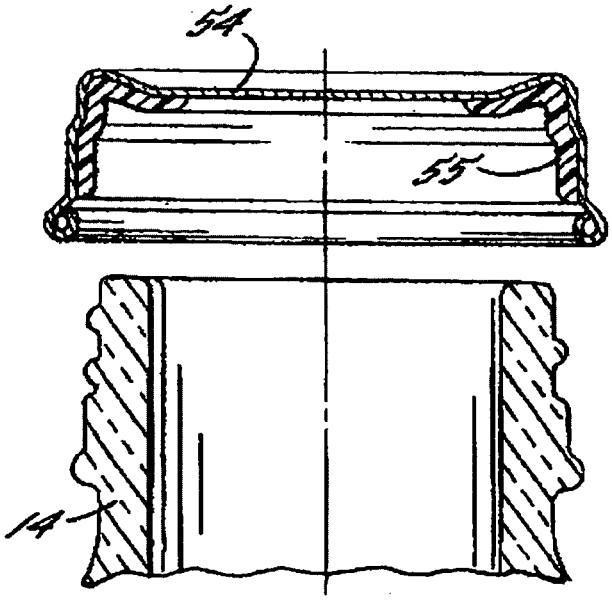
FIG. 12 is a partial cross-sectional view of an open container and a cap according to one aspect of the present invention.
Figure 13:
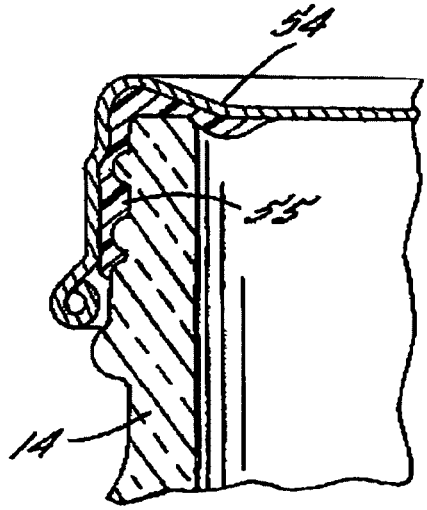
FIG. 13 is a partial cross-sectional view of a sealed container and cap according to one aspect of the present invention.

The seal station 16 operates to cap the container 14. FIG. 11E depicts an exemplary seal station 16 housed within enclosure 11 and including a cap sleeve 51, which feeds a cap release device 52. The cap release device 52 dispenses a cap 54 and positions the cap 54 over the opening of the container 14. The cap sleeve 51 and/or the cap release device 52 may include a heating element that heats the cap 54 in order to soften a material 55 (e.g., plastic) that forms at least a part of the cap 54. By way of example, the cap 54 may have a metallic exterior portion and a plastic or rubber interior portion. The seal station 16 may also include a pressure roller device 53, which assists the sealing of the heated cap 54 to the bottle threads and ensures that a tamper-detection seal is formed. FIG. 12 illustrates a heated cap 54 before it is placed on the container 14 and a seal is formed. FIG. 13 illustrates a cap 54 after the heated material 55 conforms to the shape of the container 14 thus forming a seal.

In an alternative embodiment, the apparatus 10 may include a storage station within the enclosure 11 for storing containers 14 after the containers 14 are washed, filled, and capped. The storage station may include a device capable of removing the containers 14 from the shuttle 22 and placing the containers 14 within the storage.

In another aspect, the present invention embraces a method for consecutively washing, filling, and sealing at least one container in an enclosed housing. FIGS. 11-11E depicts various steps of the method for consecutively washing, filling, and sealing at least one container in an enclosed housing.

As depicted in FIG. 11, a container 14 is provided and thereafter secured to the shuttle 22. After the container 14 is secured in the load/unload station 18, the shuttle 22 is advanced to the wash station 20. As depicted in FIGS. 11B and 11C the shuttle 22 may be rotated to drain any remaining liquid or articles from the container 14. In one embodiment, after rotation, if any, the container 14 is washed. In another embodiment, the container 14 may be washing while the container 14 is being rotated. Washing may involve spraying the interior and exterior of the container 14 with a liquid cleaning solution.

As depicted in FIG. 11D, after the container 14 is washed the shuttle 22 is rotated and advanced to the fill station 21. The fill station 21 dispenses a liquid (e.g., water or soda) into the container 14.

After the container 14 is filled, the shuttle 22 is advanced to the seal station 16. At the seal station 16, a cap 54 is placed on the container 14 and the container 14 is sealed.

The previous steps may be conducted along the travel path as described above. Moreover, the previous steps may take place as part of a timed cycle, which may take a couple of minutes (e.g., 3 minutes) to complete.

In the drawings and specification, there have been disclosed typical embodiments on the invention and, although specific terms have been employed, they have been used in a generic and descriptive sense only and not for purposes of limitation, the scope of the invention being set forth in the following claims.

The invention claimed is:

1. An apparatus for filling a container, said apparatus comprising:

an enclosure having at least one opening for receiving at least one container; and a shuttle assembly having a rotatable shuttle for receiving said at least one container, said shuttle assembly housed by said enclosure (secured to at least a portion of said enclosure), said shuttle assembly defining a frame structure, said shuttle for carrying said at least one container along a path of travel, said shuttle defining at least one opening having a variable diameter, said shuttle rotatable about a pivot point;

at least one gear for controlling the rotational position of said shuttle during travel, said gear fixed to said shuttle and positioned substantially adjacent to said shuttle; and a plurality of cams extending interior of said shuttle assembly along a travel path for directing the rotation of said gear and said shuttle;

wherein said gear engages said plurality of cams during movement of said shuttle along the travel path such that said gear rotates said shuttle about a pivot point; and wherein at least a portion of said shuttle assembly advances (or reciprocates between a plurality of stations) along a path of travel and facilitates the washing, filling, and sealing of said at least one container.

2. A filling apparatus according to claim 1 wherein said shuttle assembly comprises:

a drive assembly for driving said shuttle, said drive assembly mounted to said frame structure.

3. A filling apparatus according to claim 1 wherein said shuttle further comprises:

at least one rack for receiving and securing said at least one container;

wherein said at least one rack in a first position configured to receive said at least one container;

wherein said at least one rack in a second position configured to secure said at least one container for movement along the travel path.

4. A filling apparatus according to claim 2 wherein said drive assembly comprises:

mounting brackets for supporting said drive assembly, said shuttle drive mounting brackets secured to said frame structure, said mounting brackets having a drive sleeve connected thereto; and at least one drive assist extending between said shuttle drive mounting brackets, said at least one drive assist cooperating with said drive sleeve to advance said shuttle along the travel.

5. A filling apparatus according to claim 1 wherein said shuttle assembly further comprises:

opposing shuttle brackets for supporting said shuttle, said shuttle brackets connected to said frame structure; and at least one support member for supporting said at least one container, said at least one support member extending between said shuttle brackets.

6. A filling apparatus according to claim 1 wherein said frame structure comprises:

opposing side rails defining at least one slot that directs a portion of said shuttle assembly along the travel path; and opposing cross supports connecting said opposing side rails.

7. A filling apparatus according to claim 1 further comprising a wash station for cleaning said at least one container, said cleaning station housed by said enclosure.

8. A filling apparatus according to claim 1 further comprising a fill station for dispensing liquid into said at least one container, said filling station housed by said enclosure.

9. A filling apparatus according to claim 1 further comprising a seal station for capping said at least one container, said seal station housed by said enclosure.

10. An apparatus for washing, filling, and sealing a container, said apparatus comprising;

an enclosure having at least one opening for receiving at least one container;

a shuttle assembly having a rotatable shuttle for receiving said at least one container, said shuttle assembly secured within said enclosure;

a wash station for cleaning said at least one container, said wash station housed by said enclosure;

a fill station for dispensing liquid into said at least one container, said fill station housed by said enclosure;

a seal station for capping said at least one container, said seal station housed by said enclosure;

at least one gear for controlling the rotational position of said shuttle during travel, said gear fixed to said shuttle and positioned substantially adjacent to said shuttle; and a plurality of cams extending interior of said shuttle assembly along said travel path for directing the rotation of said gear and said shuttle;

wherein said at least one gear engages said plurality of cams during movement of said shuttle along the travel path such that said gear rotates said shuttle about a pivot point; and wherein at least a portion of said shuttle assembly moves between said wash, fill, and seal stations along a path of travel and facilitates the washing, filling, and sealing of said at least one container.

11. A washing, filling, and sealing apparatus according to claim 10 wherein said shuttle assembly comprises:

a frame structure for supporting said shuttle;

opposing side rails having a slot that directs said shuttle along the travel path;

opposing cross supports connecting said opposing side rails;

a drive assembly for driving said shuttle along the travel path, said drive assembly mounted to said frame structure.

12. A washing, filling, and sealing apparatus according to claim 11 wherein said drive assembly comprises:

mounting brackets for supporting said shuttle drive assembly, said shuttle drive mounting brackets secured to said frame structure, said shuttle drive mounting brackets having a drive sleeve connected thereto; and at least one drive assist extending between said shuttle drive mounting brackets, said at least one drive assist cooperating with said drive sleeve to advance said shuttle along the travel path.

13. A washing, filling, and sealing apparatus according to claim 10 wherein said shuttle assembly further comprises:

opposing shuttle brackets for supporting said shuttle, said shuttle brackets connected to said frame structure; and at least one support member for supporting said at least one container, said at least one support member extending between said shuttle brackets.

14. A washing, filling, and sealing apparatus according to claim 11 wherein said shuttle assembly further comprises a shuttle bearing connected to said shuttle by a pivot shaft, said shuttle bearing extending into a slot formed in said frame structure.

15. A washing, filling, and sealing apparatus according to claim 10 wherein said shuttle further comprises at least one rack for receiving said at least one container, said at least one rack defining at least one opening that is variable in diameter such that said rack in a first position is configured to receive said at least one container, and said at least one rack in a second position is configured to secure said at least one container for movement along the travel path.

16. A washing, filling, and sealing apparatus according to claim 15, wherein said at least one rack comprises:

opposing support members moveable between said first and second position;

at least one connector for moveably securing said opposing support members to one another;

at least one moveable projection for securing said at least one container, said at least one moveable projection positioned about the periphery of said at least one opening.

17. A washing, filling, and sealing apparatus according to claim 10, wherein said wash station comprises at least one device for dispensing liquid against at least a portion of said at least one container.

18. A washing, filling, and sealing apparatus according to claim 10, wherein said fill station comprises at least one device for dispensing liquid into said at least one container.

19. A washing, filling, and sealing apparatus according to claim 10, wherein said seal station comprises at least one device for sealing said at least one container.

20. A method for consecutively washing, filling, and sealing at least one container in an enclosed housing, said method comprising the steps of:

providing an enclosure having at least one opening for receiving at least one container;

providing a shuttle assembly having a rotatable shuttle for receiving said at least one container, said shuttle assembly secured within said enclosure;

providing at least one gear for controlling the rotational position of said shuttle during travel, said gear fixed to said shuttle and positioned substantially adjacent to said shuttle; and a plurality of cams extending interior of said shuttle assembly along said travel path for directing the rotation of said gear and said shuttle;

providing a wash station for cleaning said at least one container, said wash station housed by said enclosure;

providing a fill station for dispensing liquid into said at least one container, said fill station housed by said enclosure;

providing a seal station for capping said at least one container, said seal station housed by said enclosure;

washing said at least one container at the wash station;

filling said at least one container at the fill station; and sealing said at least one container at the seal station;

wherein said at least one gear engages said plurality of cams during movement of said shuttle along the travel path such that said at least one gear rotates said shuttle about a pivot point; and wherein at least a portion of said shuttle assembly moves between said wash, fill, and seal stations along a path of travel and facilitates the washing, filling, and sealing of said at least one container.

21. A method according to claim 20, wherein the step of providing at least one container comprises securing said at least one container to the shuttle.

22. A method according to claim 20, wherein the step of washing said at least one container comprises spraying the interior and exterior surfaces of said at least one container.

23. A method according to claim 22, wherein the step of washing said at least one container further comprises:

advancing said shuttle to the wash station; and rotating said at least one container;

wherein said advancing and rotating steps occur before or during said spraying step.

24. A method according to claim 20, wherein the step of filling said at least one container comprises dispensing a liquid into said at least one container.

25. A method according to claim 24, wherein the step of filling said at least one container further comprises:

rotating said at least one container; and advancing said shuttle to the fill station;

wherein said rotating and advancing steps occurring before said dispensing step.

26. A method according to claim 20, wherein the step of sealing said at least one container comprises securing a cap onto an opening of said at least one container.

* * * * *